United States Patent [19]

Masszi

[11] 4,305,464

[45] Dec. 15, 1981

[54] METHOD FOR RECOVERING METHANE FROM COAL SEAMS

[75] Inventor: Denes G. Masszi, Calgary, Canada

[73] Assignee: Algas Resources Ltd., Calgary, Canada

[21] Appl. No.: 128,469

[22] Filed: Mar. 7, 1980

[30] Foreign Application Priority Data

Oct. 19, 1979 [GB] United Kingdom ..... 36634/79

[51] Int. Cl.[3] ..... E21B 43/26; E21B 43/263

[52] U.S. Cl. ..... 166/370; 166/249; 166/299; 166/308; 299/17

[58] Field of Search ..... 166/314, 308, 249, 299; 299/2, 12, 17

[56] References Cited

U.S. PATENT DOCUMENTS

| | | | |
|---|---|---|---|
| 1,992,323 | 2/1935 | Ranney | 299/2 |
| 2,508,949 | 5/1950 | Howard | 299/2 |
| 3,384,416 | 5/1968 | Ruehl et al. | 299/12 X |
| 3,934,649 | 1/1976 | Pasini et al. | 166/314 X |
| 4,089,374 | 5/1978 | Terry | 166/314 X |
| 4,140,346 | 2/1979 | Barthel | 299/17 |

OTHER PUBLICATIONS

Elder, C. H., et al., "Degasification of the Marylee Coalbed near Oak Grove, Jefferson County, Ala., by Vertical Borehole in Advance of Mining", Report of Investigations #7968, U.S. Bureau of Mines, 1974, 21 pp.

Dew et al., "Coal Beds: A Source of Natural Gas", *The Oil and Gas Journal,* vol. 73, No. 4, Jun. 1975, pp. 47–49.

Dent et al., "Degasification of Coalbeds—a Commercial Source of Pipeline Gas", *A.G.A. Monthly,* vol. 56, No. 1, Jan. 1974, pp. 4–6.

Merritts, "Degasifying Before Mining", *Coal Age,* Aug. 1961, pp. 74–78.

*Primary Examiner*—Stephen J. Novosad

*Attorney, Agent, or Firm*—Sim & McBurney

[57] ABSTRACT

Methane is recovered from an underground coal seam via a borehole which extends from the earth's surface through the overburden to a cavity that is in, partly in or proximate to the coal seam. The cavity is constructed and arranged to be collapsible. Coal from the coal seam moves toward the coal seam under the influence of triaxial compression converting adsorbed methane to free form methane that is recovered.

9 Claims, No Drawings

METHOD FOR RECOVERING METHANE FROM COAL SEAMS

This invention relates to methods for recovering methane gas from underground coal seams. More particularly, this invention relates to methods for recovering methane gas from coal seams by a process which involves forming a cavity or opening in or adjacent to the coal seam and relying upon the pressure that is exerted on the coal seam to cause movement of the coal into the cavity converting methane in the adsorbed condition to the free state condition, the latter then being recovered.

It is well known that most coal deposits contain gas. The gas generally is comparable to natural gas by analysis and is mainly methane but also contains nitrogen and carbon dioxide.

Methane is a by-product of the coalification process. Methane results from the aerobic bacterial metabolism of cellulose, lignin, wax and resins. The process takes place in three stages. In the first stage the cellulose ferments forming primarily carbon dioxide, hydrogen and methane. As the decomposing vegetation is exposed to water or air, most of the gas is released to the atmosphere. A slow decomposition of lignin that follows in the second stage takes place in circumstances in which a sediment has accumulated over the deposit to allow moisture to be present but not air. Differential diffusion in the second stage allows carbon dioxide to be adsorbed by the water. Hydrogen is diffused through the sediment to the atmosphere, and the methane remains in the coal. In the third and final stage methane is prevented from escaping by burial and becomes trapped in the coal. With the increasing pressure at increasing depths and some permeability, some methane escapes, while some remains within the roof and floor rock. The result is a coal having a high methane content relative to carbon dioxide, hydrogen and other gases.

The presence of methane in an underground mine is undesirable from a safety point of view, so that recovering methane from coal seams results in an improvement in mine safety and also may provide a usable energy source, particularly if the methane can be recovered in large quantities.

One known technique for recovering methane from coal seams involves drilling. Thus, short drainage boreholes may be drilled into the coal seam. The boreholes are connected to a gathering system which leads the methane into the exhaust air ventilation system of the mine. Alternatively, vertical drainage holes may be drilled from the surface through the overburden into the coal seam. Also directional drainage boreholes through the overburden may be drilled parallel to the coal bedding planes into the coal, or a large diameter shaft may be drilled into the coal seam and several small diameter long drainage holes may be drilled into the coal seam from the bottom of the shaft, the small diameter drainage holes being parallel to the bedding planes of the coal. Finally, small diameter long drainage holes may be drilled into the coal seam parallel with the bedding planes through outcrops or from an underground mining area.

In order to improve the gas-flow rate from the coal seam various methods of fracturing have been used. Thus, it is common practice to pump a specially prepared fluid into the coal seam with sufficient pressure to open a fracture in the coal seam. The fluid may be water, oil, oil-water emulsion, gelled water, gelled oil or foam, and it may carry a suitable propping agent, like sand, into the fracture to hold the fracture open after the fracturing fluid has been recovered.

The basic principle of all fracturing methods is to build up a continuous fracture system in the coal seam and increase the size of the free-flow passages towards the gas collection area. The following techniques have been used in fracturing a geological formation: 1. continuous injection of fluid; 2. pulsating injection of fluid; 3. injection of acid; and 4. blasting with a chemical or nuclear explosive positioned in the geological formation.

The instant invention relies upon an entirely different technique to stimulate the flow of methane from a coal seam and is based upon recognition of the fact that approximately 90% of the methane distributed in a coal seam is in the adsorbed form, whereas only 10% is in the free form. The ability of the adsorbed methane to flow is governed by diffusion. The drilling and fracturing techniques outlined hereinbefore only are capable of recovering methane existing in its free form.

In accordance with one aspect of this invention there is provided a process for recovering from an underground coal seam methane gas which occurs in adsorbed form in said coal seam, said process comprising providing a borehole which extends from the surface of the earth underground through overburden to a terminal point, providing at said terminal point an underground cavity at least partly in or immediately adjacent to said coal seam, said cavity being located such that the pressure of said overburden is greater than the crushing strength of said cavity, said cavity having a radius at least five times the radius of said borehole at said terminal point, said cavity being unsupported, non-self-portecting and, hence, collapsible and constructed and arranged such that under the influence of triaxial compression coal from said coal seam will move toward and into said cavity, thereby fracturing and converting methane gas adsorbed in the coal into methane gas in free form, and recovering said free form methane gas from said cavity via said borehole.

The cavity may be created by any standard technique, for example, hydraulic, mechanical, chemical, or compressed air techniques. For example, a borehole may be drilled into the earth from a surface location through the overburden, and the cavity can be formed at the terminus of the borehole using water or air jet methods. A hydraulic mining device developed by Flow Research Incorporated could be used, for example, to form the cavity. The cavity is not provided with any support, so no propping agents or casings are employed, and the cavity should not be constructed in a self-protecting form. The cavity must be capable of collapsing.

An underground coal seam is in triaxial compression with the rock pressure being proportional to the depth of the coal seam. The effect of creating a cavity in or adjacent to the coal seam is to change the triaxial compression of the seam such that coal particles under the effect of the surrounding rock pressure will begin to move in the direction of the free surface bounding the cavity. The result of this is that more surface area of the coal is exposed resulting in methane in the coal seam being changed from the adsorbed condition into the external surface or free state condition in which it can be recovered by conventional recovery techniques from the surface via the borehole. In other words, the creation of an unsupported cavity in or adjacent to the coal seam results in movement of the coal towards that cavity, and the movement of the coal changes the state of the methane in the coal from the adsorbed condition to the free state condition. During movement of the coal more and more pore surface area of the coal will become exposed gradually resulting in a higher gas-flow rate and in the formation of a loose, high permeability zone.

The cavity may be located entirely within the coal seam. Depending on the nature of the material surrounding the coal seam, it may be located partly therein and partly in the coal seam or immediately adjacent to the coal seam. In any event, it must be located such that under the influence of triaxial compression coal from the coal seam will move toward the cavity.

In order to enhance movement of the coal toward the cavity, hydraulic pressure may be applied to the coal outside of the cavity, or a pulsating pressure effect may be created through application of vibrations from a mechanical vibrator or by blasting.

As previously indicated, in the practice of this invention a borehole is drilled from the surface and a cavity formed at the terminus of the borehole. Methane recovery equipment may be provided at the surface end of the borehole. The recovered methane may be burned in situ or otherwise consumed, e.g., in a fuel cell. It may be liquified or compressed and stored. It may be cleaned, e.g., to remove air and water and extract hydrogen therefrom. It may be compressed and directed into a pipeline.

An additional advantage of the process of this invention is that stress in the coal seam is relieved in and around the area in which the cavity was formed, making it easier to mine the coal that occupies the cavity after the collapse of the walls thereof and the coal in the area around the collapsed cavity. By applying the technique of this invention to the whole coal seam, there is created a demethanated coal seam that has been stress relieved and that is ready to be relatively easily mined.

The instant invention is dependent upon coal moving from a position adjacent the formed cavity into the cavity itself. The affected area of the coal seam can be referred to as the disturbed zone, this being the zone of fractured coal that exists after the cavity has collapsed.

In order to ensure movement of the coal into the cavity, the cavity must be formed sufficiently deep that the pressure of the overburden is greater than the crushing strength of the cavity. Additionally, for bright coal, which is a light, soft, friable coal which breaks into small pieces, the radius of the cavity must be greater than five times the radius of the borehole where it intersects the cavity. In the case of dull or blocky coal, which is harder and breaks into larger pieces than bright coal, the radius of the cavity must be greater than ten times the radius of the borehole where it intersects the cavity. It must be appreciated, of course, that where reference is made herein, and in the claims, to the radius of the cavity, this is an idealized radius, since the cavity may not have circular walls. It is the radius of a cylindrical cavity having the same volume and length as the actual cavity.

The volume of the cavity can be calculated from the following formula:

$$V_1 = Q/K_1$$

where, $V_1$ = the volume of the cavity in $m^3$, $Q$ = the volume of the coal removed from the cavity in $m^3$, and $K_1$ = the swelling factor (generally 1.5).

The swelling factor is determined by the nature of the material removed to form the cavity.

The volume of the disturbed zone, which is related to the volume of methane that can be expected to be recovered, is given by the following formula:

$$V_2 = h^2 \pi m$$

where, $V_2$ = the volume of the disturbed zone in $m^3$ $h$ = the idealized radius of the disturbed zone measured perpendicular to the borehole in m, $m$ = the length of the cavity in m, $$h = \sqrt{\frac{Q\,K_2}{m\,\pi\,K_1(K_2 - 1)}}$$

where $K_2$ = the swelling factor of the disturbed zone (generally 1.1).

The size of the disturbed zone can be calculated for the specific circumstances of the site. Once this has been determined, the required size of the cavity can be calculated using the foregoing formulae.

While a preferred embodiment of this invention has been disclosed herein, changes and modifications may be made therein without departing from the spirit and scope of this invention as defined in the appended claims.

What I claim is:

1. A process for recovering from an underground coal seam methane gas which occurs in adsorbed form in said coal seam, said process comprising providing a borehole which extends from the surface of the earth underground through overburden to a terminal point, providing at said terminal point an underground cavity at least partly in or immediately adjacent to said coal seam, said cavity being located such that the pressure of said overburden is greater than the crushing strength of said cavity, said cavity having a radius at least five times the radius of said borehole at said terminal point, said cavity being unsupported, non-self-protecting and, hence, collapsible and constructed and arranged such that under the influence of triaxial compression coal from said coal seam will move toward and into said cavity, thereby fracturing and converting methane gas adsorbed in the coal into methane gas in free form, and recovering said free form methane gas from said cavity via said borehole.

2. A process according to claim 1 wherein said cavity is entirely within said coal seam.

3. A process according to claim 1 wherein said cavity is only partly in said coal seam.

4. A process according to claim 1 wherein said cavity is immediately adjacent to said coal seam.

5. A process according to claim 1 including the steps of boring said borehole from the surface of the earth underground and forming said cavity at the underground end of said borehole.

6. A process according to claim 5 including the step of assisting the collapse of said cavity by applying external forces that are transmitted to the walls of said cavity.

7. A process according to claim 1 including the step of assisting the collapse of said cavity by applying external forces that are transmitted to the walls of said cavity.

8. A process according to claim 1 wherein said coal of said seam is bright coal.

9. A process according to claim 1 wherein said coal of said coal seam is dull or blocky coal and said radius of said cavity is at least ten times the radius of said borehole at said terminal point.

* * * * *